US009630210B2

(12) United States Patent
Zumberger et al.

(10) Patent No.: US 9,630,210 B2
(45) **Date of Patent: *Apr. 25, 2017**

(54) METHOD FOR LINING CONTAINER CLOSURES

(71) Applicant: Stolle Machinery Company, LLC, Centennial, CO (US)

(72) Inventors: Neil A Zumberger, Sidney, OH (US); Gregory H Butcher, Columbus, OH (US); Aaron E Carstens, Centerville, OH (US); John A Davidson, Sidney, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/204,192

(22) Filed: Jul. 7, 2016

(65) Prior Publication Data

US 2016/0325308 A1 Nov. 10, 2016

Related U.S. Application Data

(60) Continuation of application No. 14/451,976, filed on Aug. 5, 2014, now Pat. No. 9,475,091, which is a division of application No. 13/459,609, filed on Apr. 30, 2012, now Pat. No. 8,826,850.

(51) Int. Cl.

| | |
|---|---|
| ***B05D 7/22*** | (2006.01) |
| ***B05D 3/12*** | (2006.01) |
| ***B05D 1/00*** | (2006.01) |
| ***B05D 1/26*** | (2006.01) |
| ***B05D 1/02*** | (2006.01) |
| ***B05C 5/02*** | (2006.01) |
| *B05C 5/00* | (2006.01) |
| *B05B 13/02* | (2006.01) |
| *B05B 7/06* | (2006.01) |
| *B05B 13/06* | (2006.01) |
| *B05C 13/02* | (2006.01) |

(52) U.S. Cl.

CPC ..... *B05D 7/227* (2013.01); *B05C 5/022* (2013.01); *B05D 1/002* (2013.01); *B05D 1/02* (2013.01); *B05D 1/26* (2013.01); *B05D 3/12* (2013.01); *B05D 7/22* (2013.01); *B05C 13/02* (2013.01)

(58) Field of Classification Search

CPC . B05D 1/00; B05D 1/002; B05D 1/02; B05D 1/26; B05D 3/12; B05D 7/22; B05D 7/227

USPC ..... 427/230–239

See application file for complete search history.

(56) References Cited

U.S. PATENT DOCUMENTS

| | | | | |
|---|---|---|---|---|
| 1,894,729 | A | 1/1933 | Bozarth | |
| 2,600,138 | A * | 6/1952 | Tesch, Jr. | B65G 47/848 221/211 |
| 2,795,818 | A * | 6/1957 | Bertorello | B21D 51/2661 118/410 |
| 3,445,262 | A * | 5/1969 | Greck | B05D 1/02 118/302 |
| 3,745,953 | A * | 7/1973 | Hurst | B21D 51/46 413/59 |
| 4,605,351 | A | 8/1986 | Hatcher et al. | |
| 5,564,877 | A | 10/1996 | Hamilton | |
| 5,749,969 | A | 5/1998 | Kobak et al. | |
| 5,945,160 | A | 8/1999 | Kobak et al. | |
| 6,090,203 | A | 7/2000 | Gebhardt et al. | |
| 6,730,168 | B1 | 5/2004 | Ross | |
| 2014/0338595 | A1 | 11/2014 | Zumberger et al. | |

FOREIGN PATENT DOCUMENTS

| | | |
|---|---|---|
| GB | 2042373 | 9/1980 |

OTHER PUBLICATIONS

Stolle Machinery Company, LLC, PCT/US2013/036910 International Search Report and Written Opinion, dated Jul. 22, 2013, 9 pages.

Stolle Machinery Company, LLC, EP 13 78 4527 Supplementary European Search Report, Mar. 31, 2016, 9 pages.

* cited by examiner

*Primary Examiner* — William Phillip Fletcher, III

(74) *Attorney, Agent, or Firm* — Eckert Seamans Cherin & Mellott, LLC; David C. Jenkins

(57) ABSTRACT

A method of lining container closures includes providing a liner machine base including a number of fluid dispensing apparatus fixed in a stationary position on the base, conveying a plurality of container closures to the fluid dispensing apparatus using a conveying assembly, manipulating each of the container closures with respect to a corresponding one of the fluid dispensing apparatus as the fluid dispensing apparatus remains stationary and dispenses a sealant, lining a plurality of the container closures with said sealant, and, discharging the container closures from the liner machine.

9 Claims, 8 Drawing Sheets

METHOD FOR LINING CONTAINER CLOSURES

CROSS-REFERENCE TO RELATED APPLICATIONS

This application is a continuation of U.S. patent application Ser. No. 14/451,976, filed on Aug. 5, 2014, now issued as U.S Pat. No 9,475,091, which is a divisional of U.S. patent application Ser. No. 13/459,609, filed on Apr. 30, 2012, now issued as U.S. Pat. No. 8,826,850, the contents of which are incorporated in their entirety herein by reference.

BACKGROUND

Field

The disclosed concept relates generally to machinery for container closures and, more particularly, to liners and methods for lining container closures such as, for example, can ends, with a sealant material.

Background Information

It is known to apply sealant material, commonly referred to as compound, to the underside of container closures to facilitate subsequent sealing attachment (e.g., without limitation, seaming) of the closures to containers such as, for example, beer/beverage and food cans.

FIGS. 1A and 1B, for example, show a container closure 1, commonly referred to as a can lid, shell or can end, for sealing the open end of a can 3 (e.g., without limitation, a beer or beverage can; a food can). During the manufacture of the can end 1, sealant material 5 (e.g., compound) is applied in an annular pattern on the underside 7 of the curl region 9 of the can end 1, as shown in FIG. 1A. As shown in FIG. 1B, after the can 3 has been filled, the can end 1 is seamed onto an upper flange 11 of the can 3. The previously applied sealant material 5 is disposed between the curl region 9 of the end 1 and the upper flange 11 of the can 3 to provide an effective seal therebetween.

FIG. 2 shows an example rotary liner machine 13, which is typically used to apply sealant 5 (FIGS. 1A and 1B) to can ends 1 (shown in phantom line drawing in FIG. 2) in relatively high volume applications. The rotary liner 13 generally includes a base 15 having a chuck assembly 17. As shown in FIG. 2, a pivotal upper turret assembly 18, which is disposed over the chuck assembly 17 and includes an electrical tank assembly 19, a rotary compound tank assembly 20, and a number of peripherally disposed fluid dispensing apparatus 21 (e.g., sealant or compound guns). A lower turret assembly 22 (shown in simplified form in hidden line drawing in FIG. 2) rotates the chucks. A downstacker 23 delivers the can ends 1 to a star wheel (hidden in FIG. 2) which, in turn, cooperates with corresponding chuck members 27 of the chuck assembly 17 to support and rotate the can ends 1 relative to the fluid dispensing apparatus 21.

Specifically, the star wheel (not shown) rotates the can ends 1 onto the chuck members 27, which are raised by cams to receive the can ends 1. The chuck members 27 then begin to rotate the can ends 1, which is commonly referred to as "pre-spin." Once the can ends 1 reach the desired rotational velocity, the sealant 5 (FIGS. 1A and 1B) is applied (e.g., without limitation, sprayed onto) to the can ends 1 by the fluid dispensing apparatus 21. This is commonly referred to as the "spray time." After the sealant 5 (FIGS. 1A and 1B) is applied, the can ends 1 continue to be rotated for a relatively brief period of time to smooth out the sealant 5. This is commonly referred to as the "post spin time." Finally, the cams lower the chuck members 27 and can ends 1, and each can end 1 is removed and discharged from the rotary liner machine 13 via an unloading guide 29, as shown.

Among other disadvantages of such rotary liner designs, the pivotal turret assemblies (e.g., without limitation, upper turret assembly 18, electrical tank assembly 19, rotary compound tank assembly 20, and lower turret assembly 22 of FIG. 2) are relatively complex and require a number of components that are susceptible to failure such as, for example and without limitation, electrical and compound rotary unions, and associated processors. The centrifugal forces associated with rotation of the spray guns 21 also create a variety of problems. For example and without limitation, air rushing past the nozzles of the rotating guns 21 causes issues with nozzles collecting compound, then throwing compound, requiring surfaces to be cleaned. Furthermore, the fact that all of the sealant guns 21 rotate together means that the entire system must be shut down in order to maintain or clean a single gun 21.

There is, therefore, room for improvement in liner machines and associated methods.

SUMMARY

These needs and others are met by embodiments of the disclosed concept, which are directed to a linear liner and associated method. Among other advantages, the linear liner eliminates a number of complex components such as rotary unions (e.g., without limitation, electrical unions; sealant or compound unions) and processors, and the individual sealant guns are stationary allowing each of them to be cleaned and maintained, individually, without interrupting the operation of the other guns. The linear liner also utilizes a modular design that can easily be expanded or otherwise adjusted to accommodate lining a wide variety of different can ends, and can be built around the production output of the shell press.

As one aspect of the disclosed concept, a liner comprises a base; a number of fluid dispensing apparatus fixed in a stationary position on the base; a conveying assembly for conveying a plurality of container closures to the fluid dispensing apparatus; and a manipulation mechanism structured to manipulate each of the container closures with respect to a corresponding one of the fluid dispensing apparatus as the fluid dispensing apparatus dispenses a sealant to line the container closures.

The liner may include a plurality of the fluid dispensing apparatus disposed in a linear configuration on the base. Each of the fluid dispensing apparatus may comprise a sealant gun. The liner may include a plurality of independent lining stations, wherein each independent lining station includes one of the sealant guns. The conveying assembly may comprise a conveyor belt. The conveyor belt may extend longitudinally across the base to deliver the container closures to each of the independent lining stations. The conveying assembly may further comprise cleats and an air supply, wherein the cleats are disposed on the conveyor belt to facilitate movement of the container closures to the independent lining stations, and wherein the air supply is structured to move each of the container closures from the conveyor belt into position beneath a corresponding one of the sealant guns.

The conveying assembly may further comprise a supply mechanism for supplying the container closures to the conveyor belt. The supply mechanism may be a downstacker coupled to the base over the conveyor belt. Alternatively, the supply mechanism may be a belt infeed assembly. The belt infeed assembly may comprise an infeed conveyor disposed substantially perpendicularly to the conveyor belt for delivering the container closures onto the conveyor belt. The infeed conveyor may include a pair of opposing guides and a stop gate, wherein the pair of opposing guides are structured to guide the container closures toward the conveyor belt, and wherein the stop gate is structured to move between an unactuated position, corresponding to the stop gate being retracted to permit the container closures to continue to move onto the conveyor belt, and an actuated position corresponding to the stop gate being extended to stop movement of the container closures.

The manipulation mechanism may comprise a number of motors and at least one wheel member, wherein the motor rotates the wheel member(s), thereby spinning the container closure(s) with respect to the dispensing apparatus.

An associated method of lining container closures is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1A:
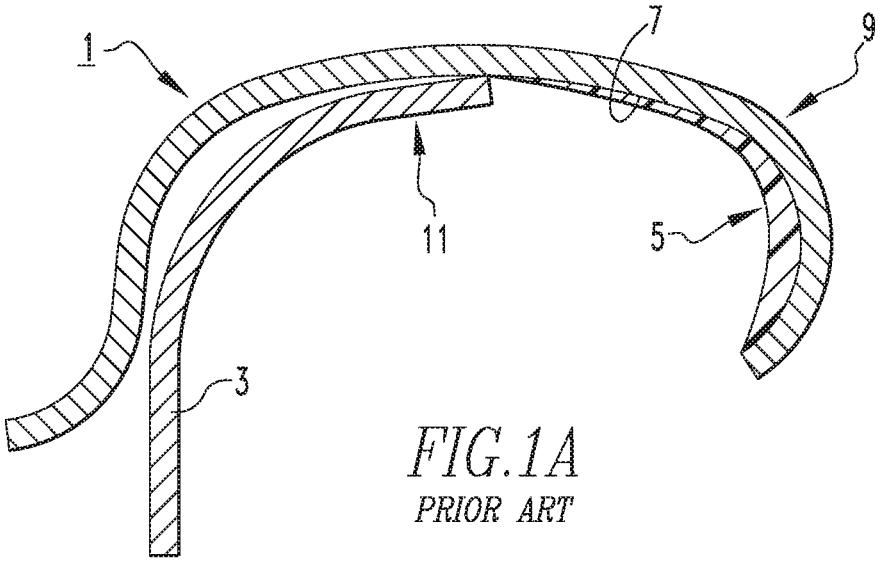
FIG.1A PRIOR ART
FIG. 1A is a side elevation view of a section of a container closure showing the placement of sealant prior to the container closure being seamed to a container.
Figure 1B:
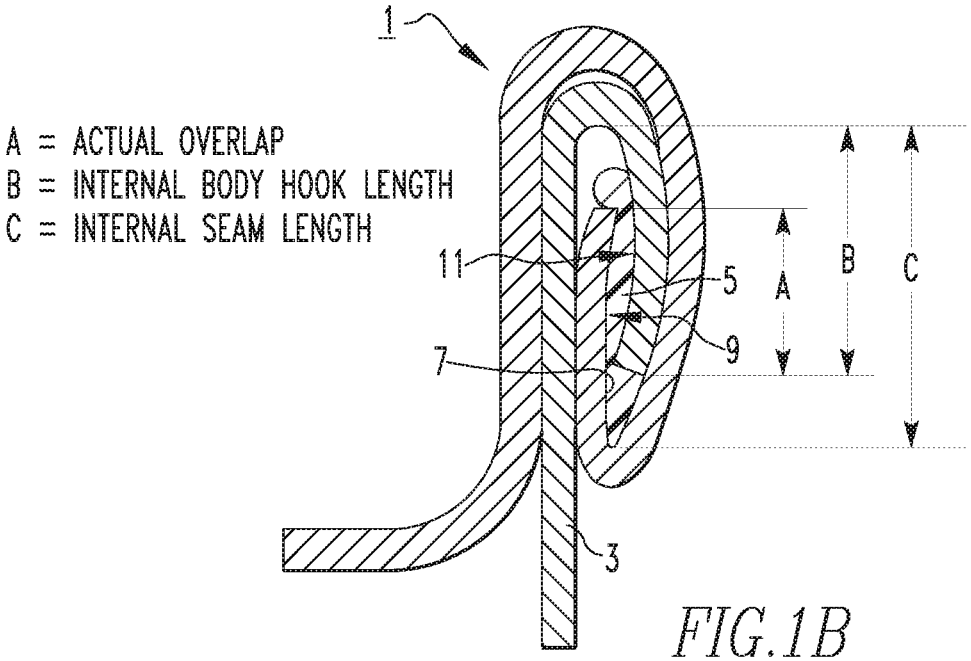
FIG.1B PRIOR ART
FIG. 1B is a side elevation view of a section of the container closure and container of FIG. 1A modified to show the container closure after being seamed to the container.

Directional phrases used herein, such as, for example, up, down, clockwise, counterclockwise and derivatives thereof, relate to the orientation of the elements shown in the drawings and are not limiting upon the claims unless expressly recited therein.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the terms "container closure," "can end," "shell," and/or "lid" are generally synonymous and are used substantially interchangeably to refer to any known or suitable closure member that is applied to (e.g., with limitation, seamed to) the open end of a container (e.g., without limitation, beverage can; food can) to seal the contents of the container therein.

As employed herein, the term "productivity" refers to the output of the linear liner and is preferably measured in container closures per minute, more commonly referred to in the industry as "ends per minute" (EPM).

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 3:
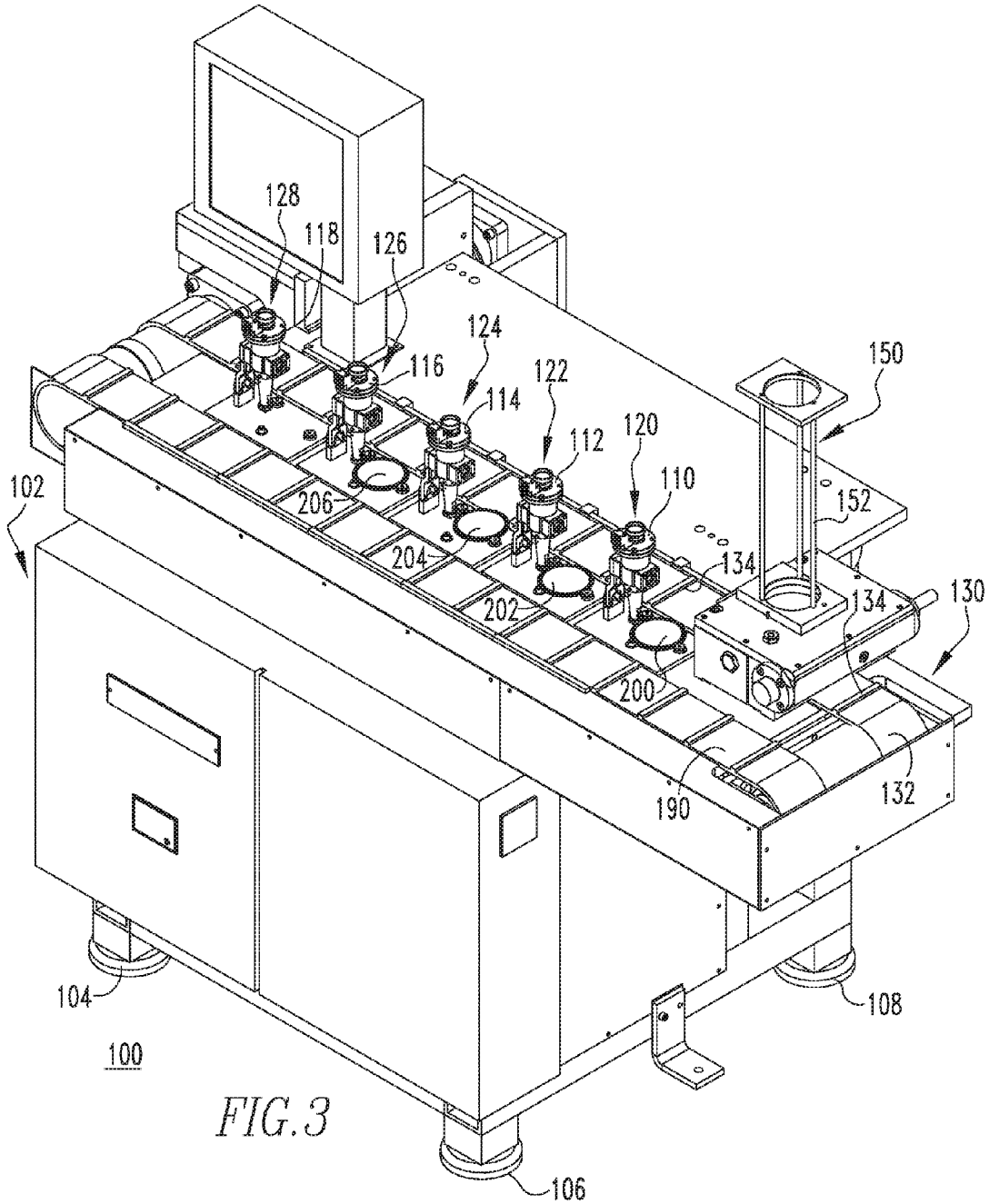
FIG. 3 is an isometric view of a linear liner in accordance with one non-limiting embodiment of the disclosed concept.

FIG. 3 shows a liner machine 100, commonly referred to as simply as a "liner," which has a linear configuration in accordance with one non-limiting embodiment of the disclosed concept. The liner 100 preferably includes a base 102 having a plurality of feet (four legs; only three legs 104, 106, 108 are partially shown in the isometric view of FIG. 3). A number of fluid dispensing apparatus 110 are fixed in a stationary position on the base 102. For example and without limitation, in the non-limiting embodiment of FIG. 3, five fluid dispensing apparati (e.g., without limitation, sealant guns 110, 112, 114, 116, 118) are disposed in a linear configuration on the base 102 to form a plurality of independent lining stations (e.g., without limitation, 120, 122, 124, 126, 128), as shown. It will be appreciated that, while the example of FIGS. 3-5 employs manual guns (e.g., 110), electronic guns (e.g., without limitation, electronic adjust; servo adjust) guns (see, for example, electronic gun 110' of FIGS. 6 and 7) could be employed in accordance with the disclosed concept.

Figure 2:
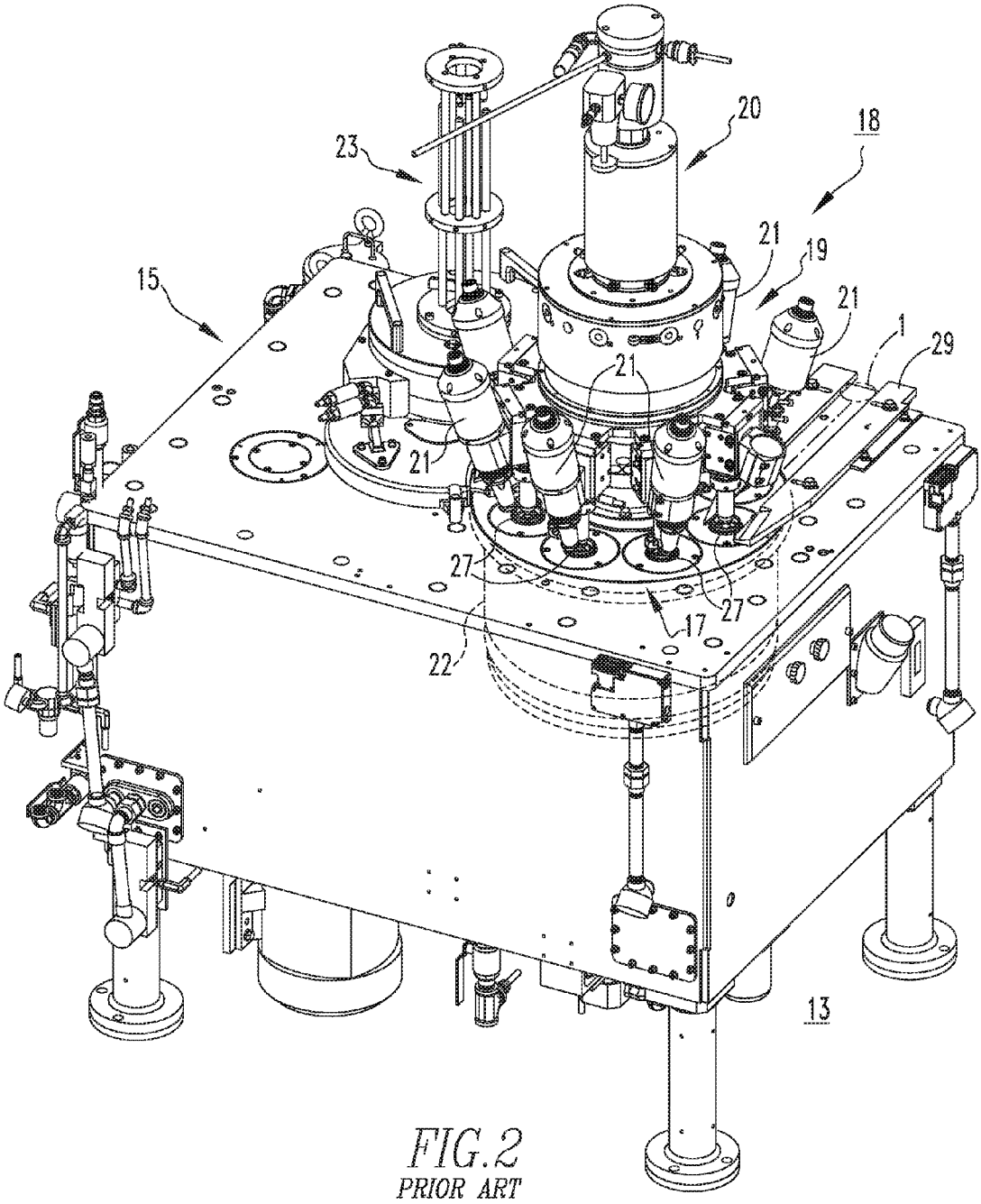
FIG.2 PRIOR ART
FIG. 2 is an isometric view of a rotary liner.

Among other benefits, it will be appreciated that the disclosed linear liner 100 eliminates relatively complex rotary unions (see, for example, electrical and compound rotary unions associated with electrical tank and/or rotary compound tank assemblies 19, 20 of FIG. 2), which are a common failure point in rotary liners (see, for example, rotary liner machine 13 of FIG. 2). The linear liner 100 also eliminates a tank of processors, which is required by such rotary liners. Thus, the number and complexity of liner components is decreased, as is the associated cost of the liner 100, and the reliability of the liner 100 is simultaneously increased. In addition, because of the independent lining station design and linear configuration, it is possible to shut down or stop operation of one individual sealant gun (e.g., without limitation, sealant gun 110), for example and without limitation, to clean and/or otherwise maintain it, without interrupting the operation of the other guns (e.g., without limitation, sealant guns 112, 114, 116, 118). In other words, unlike rotary liner designs (see, for example, rotary liner 13 of FIG. 2), wherein all of the spray heads and the entire machine must be shut down in order to maintain and/or clean a single sealant gun, with the disclosed linear liner 100, the remainder of the sealant guns (e.g., without limitation, sealant guns 112, 114, 116, 118) can continue to operate and line container closures 200. This results in substantially less downtime, and increased productivity.

Furthermore, it will be appreciated that the individual sealant guns 110, 112, 114, 116, 118 are stationary and, therefore, can be suitably adjusted manually and/or electronically, independently. Among other advantages, this modular design allows the liner 100 to be built around the production output of the corresponding shell press (not shown) and, therefore, can result in significant reduction in conveying equipment. It also results in substantially reduced time and cost associated with changing container closure sizes, due to the reduced number of parts that must be changed or otherwise adjusted. The disclosed independent station linear configuration also provides for relatively easy expansion. In other words, known rotary liner designs (see, for example, rotary liner 13 of FIG. 2) have a limited, fixed number of fluid dispensing apparatus (e.g., sealant guns 21 of FIG. 2), wherein the number of sealant guns has traditionally been limited based upon the largest container closure size. The disclosed linear liner 100 is not limited by the container closure size, and is relatively easily expandable, for example, if production needs are increased.

A conveying assembly 130 conveys the container closures 200 to the sealant guns 110, 112, 114, 116, 118. In the example shown and described herein, the conveying assembly 130 comprises a conveyer belt 132, which extends longitudinally across the base 102 of the liner 100 to deliver the container closures 200, 202, 204, 206 to the independent lining stations 120, 122, 124, 126, respectively. In the non-limiting embodiment of FIG. 3, independent lining station 128 is shown without a container closure.

The conveyor belt 132 preferably includes a plurality of cleats 134, which are spaced apart and designed to facilitate carrying the container closures 200, 202, 204, 206 to the lining stations 120, 122, 124, 126. An air supply 136 (shown in simplified form in FIG. 5) may be included to further facilitate movement of the container closures 200 from a conveyor belt 132 into position beneath the corresponding sealant gun 110. For example and without limitation, the air supply 136 (FIG. 5) could be suitably connected to an air nozzle 138 (shown in simplified form in FIG. 5), and could be suitably programmed and controlled to discharge air to move the container closures 200, 202 into independent lining stations 120, 122, respectively, as desired. It will be appreciated, however, that any known or suitable alternative type and/or configuration of conveying assembly (not shown) could be employed, other than the disclosed conveyor belt 132, shown and described herein, without departing from the scope of the disclosed concept. It will further be appreciated that while the disclosed linear liner 100 shows five independent lining stations 120, 122, 124, 126, 128 (all shown in FIG. 3), that any known or suitable alternative number and/or configuration (not shown) of stations and/or fluid dispensing apparatus (e.g., without limitation, sealant guns 110, 112, 114, 116, 118) therefor, could be employed in accordance with the disclosed concept.

Figure 8:
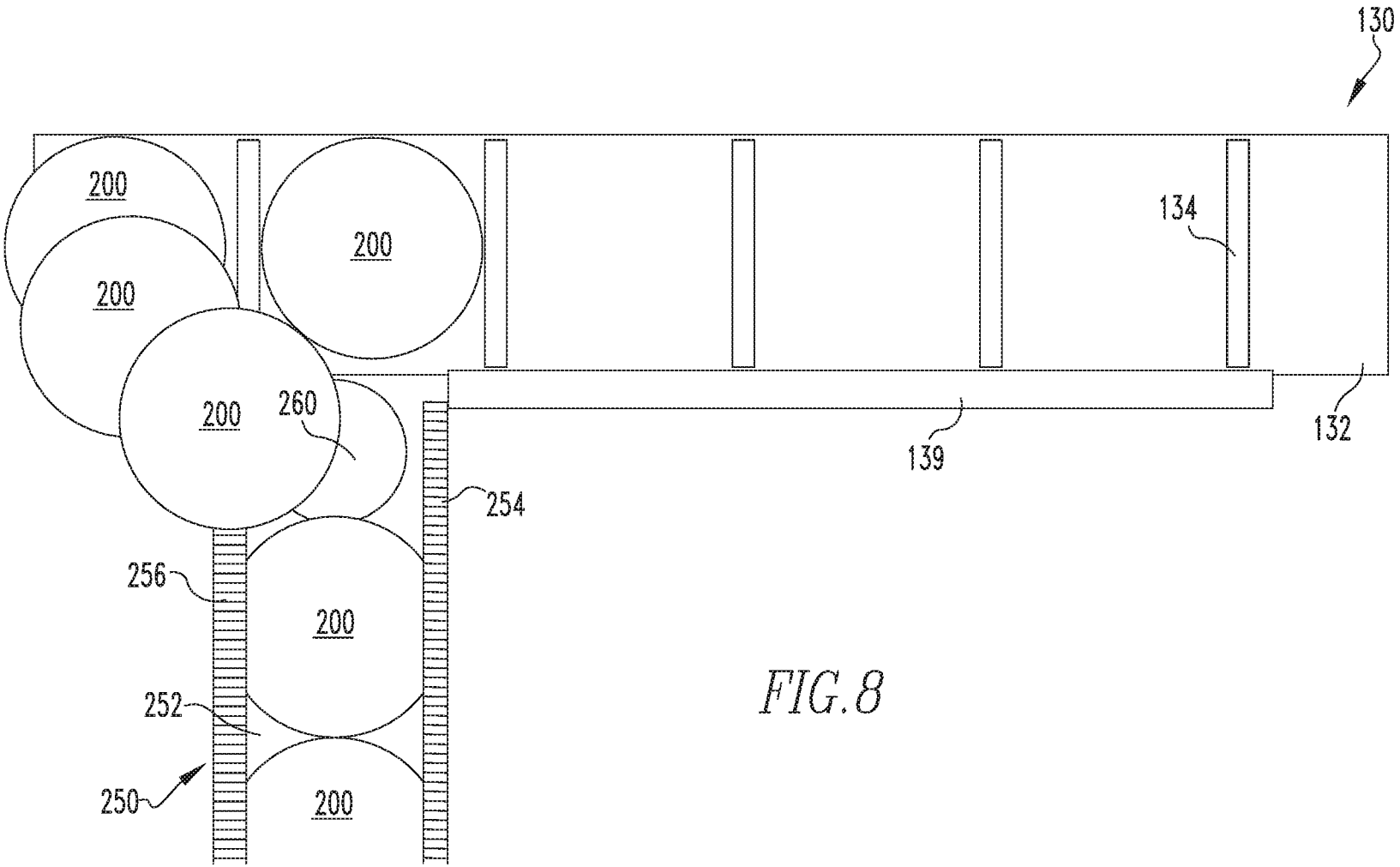
FIG. 8 is a simplified top plan view of a portion of a linear liner, in accordance with another non-limiting embodiment of the disclosed concept.

Continuing to refer to FIG. 3, it will be appreciated that the example linear liner 100 further preferably includes a supply mechanism 150. In FIG. 3, the supply mechanism 150 is a downstacker 152, which is coupled to the base 102 over the aforementioned conveyor belt 132, as shown. The downstacker 152 is structured to hold a vertical column of container closures (e.g., without limitation, 200) for purposes of suitably supplying such container closures 200 to the conveyor belt 132. It will, however, be appreciated that any known or suitable alternative type and/or configuration of supply mechanism could be employed. For example and without limitation, FIG. 8 shows a non-limiting alternative embodiment of a supply mechanism that comprises a belt infeed assembly 250. The belt infeed assembly 250 includes an infeed conveyor 252, which is disposed substantially perpendicularly to the conveyor belt 132 for delivering container closures 200 onto the conveyor belt 132, as shown. More specifically, the belt infeed assembly 250 may include a pair of opposing guides 254, 256 and an air-operated stop gate 260. The opposing guides 254, 256 are structured to suitably guide the container closures 200 toward the conveyor belt 132. The stop gate 260 is structured to move between an unactuated position, corresponding to a stop gate 260 being retracted to permit the container closures 200 to continue to move onto the conveyor belt 132, and an actuated position, corresponding to the stop gate 260 being extended upwardly to obstruct and stop movement of the container closures 200. It will be appreciated that the stop gate 260 could be suitably connected to a controller (not shown) for synchronizing the high-speed control of a container closures 200 entering the conveyor belt 132 and making sure each container closure 200 is properly indexed, as desired.

Figure 4:
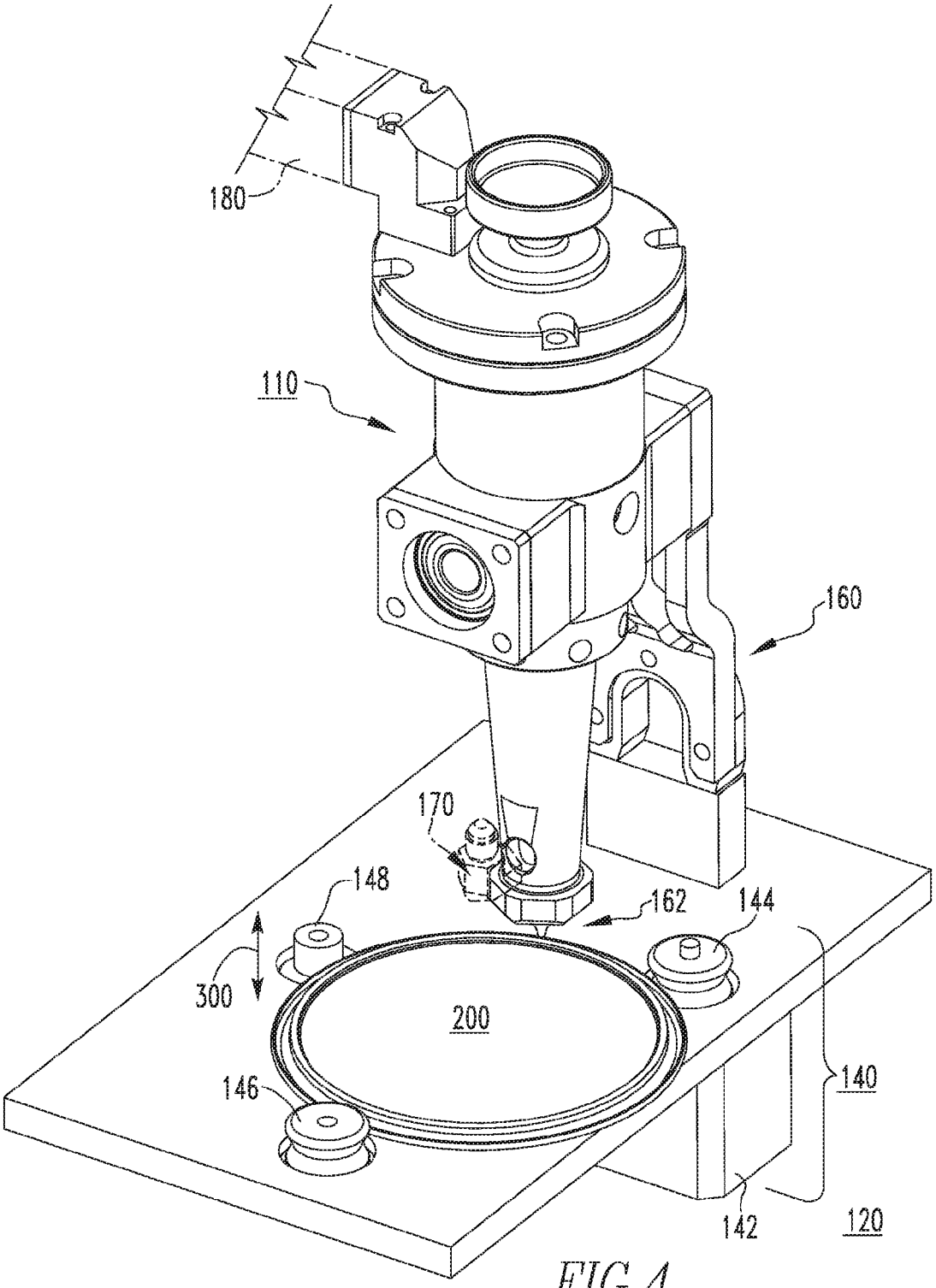
FIG. 4 is an isometric view of a portion of the linear liner of FIG. 3.
Figure 5:
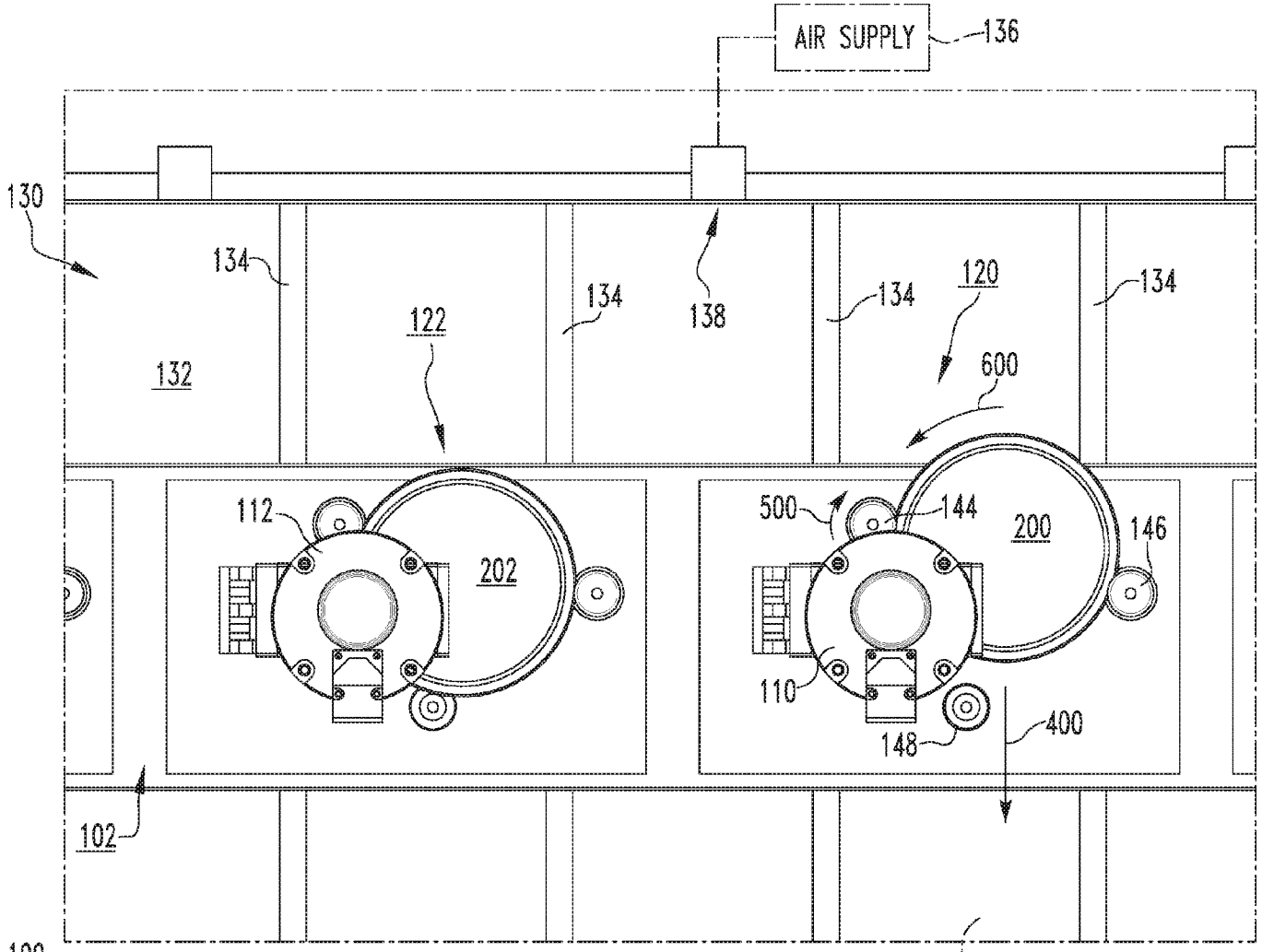
FIG. 5 is a top plan view of the portion of the linear liner of FIG. 4.

As best shown in FIGS. 4 and 5, a manipulation mechanism 140 is structured to manipulate each of the container closures 200 with respect to a corresponding one of the sealant guns 110 as the sealant gun 110 dispenses a sealant to line the container closure 200. In other words, the sealant gun 110 remains fixed in a stationary position while the container closures 200 are moved (e.g., rotated). In the example shown and described herein, the manipulation mechanism 140 includes a number of motors 142 (one motor 142 is partially shown in FIG. 4) and at least one wheel member 144, 146 (two wheel members 144, 146 are shown in the example of FIGS. 4 and 5). The motor 142 rotates one or more of the wheel members 144 (see, for example, wheel member 144 rotating clockwise in the direction of arrow 500 from the perspective of FIG. 5), thereby spinning (e.g., rotating counterclockwise in the direction of arrow 600 from the perspective of FIG. 5) the container closure 200 with respect to the sealant gun 110. It will be appreciated that movement (e.g., rotation) of the container closure 200 with respect to the sealant gun 110, which remains fixed in a stationary position in accordance with the disclosed concept, results in a number of advantageous benefits. For example and without limitation, the centrifugal force associated with rotation of a rotary liner (see, for example and without limitation, rotary liner machine 13 of FIG. 2) is eliminated, along with the passing of air over the sealant gun nozzles as the assembly rotates. Consequently, the sealant compound and, in particular, the consistency and control of the compound weight, can be more accurately controlled to produce a better product, use less material, and allow the sealant guns (e.g., 110) to run cleaner.

As shown in FIG. 4, which illustrates one non-limiting embodiment of a single independent lining station 120, the sealant gun 110 includes a mount 160 for fixedly mounting the gun 110 in a stationary position with respect to the base 102. Thus, as previously discussed hereinabove, the manipulation mechanism 140 positions and manipulates the container closure 200 with respect to the gun nozzle 162, as desired. In FIG. 4, the sealant gun 110 also includes a sealant or compound supply connection or conduit 170 (partially shown in simplified form in phantom line drawing in FIG. 4) for supplying a volume of compound or sealant to the gun 110, and an electrical connection 180 (partially shown in simplified form in phantom line drawing in FIG. 4) for providing any known or suitable electrical connections to control the operation of the gun 110 and, in particular, dispersing of sealant from the gun nozzle 162, as desired.

In the non-limiting embodiment of FIG. 4, the manipulation mechanism 140 further includes a stop member 148 for facilitating the positioning of the container closure 200 with respect to the sealant gun nozzle 162. The stop member 148 may be structured to move (e.g., without limitation, extend (as shown) and retract (not shown) upward and downward in the direction generally indicated by arrow 300 of FIG. 4). Accordingly, when the stop member 148 is extended, as shown in FIG. 4, it maintains the desired position of the container closure 200 with respect to the sealant gun nozzle 162. Then, after the container closure 200 has been suitably lined by the sealant gun 160, the stop member 148 may be retracted, for example, so that the container closure 200 can be discharged (e.g., without limitation, moved in the direction generally indicated by arrow 400 of FIG. 5) from the independent lining station 120 onto a suitable discharge mechanism, which in the example shown and described herein is a discharge conveyor belt 190 (FIGS. 3 and 5). It will, however, be appreciated that any known or suitable alternative type and/or configuration of discharge mechanism (not shown) could be employed, without departing from the scope of the disclosed concept.

Figure 6:
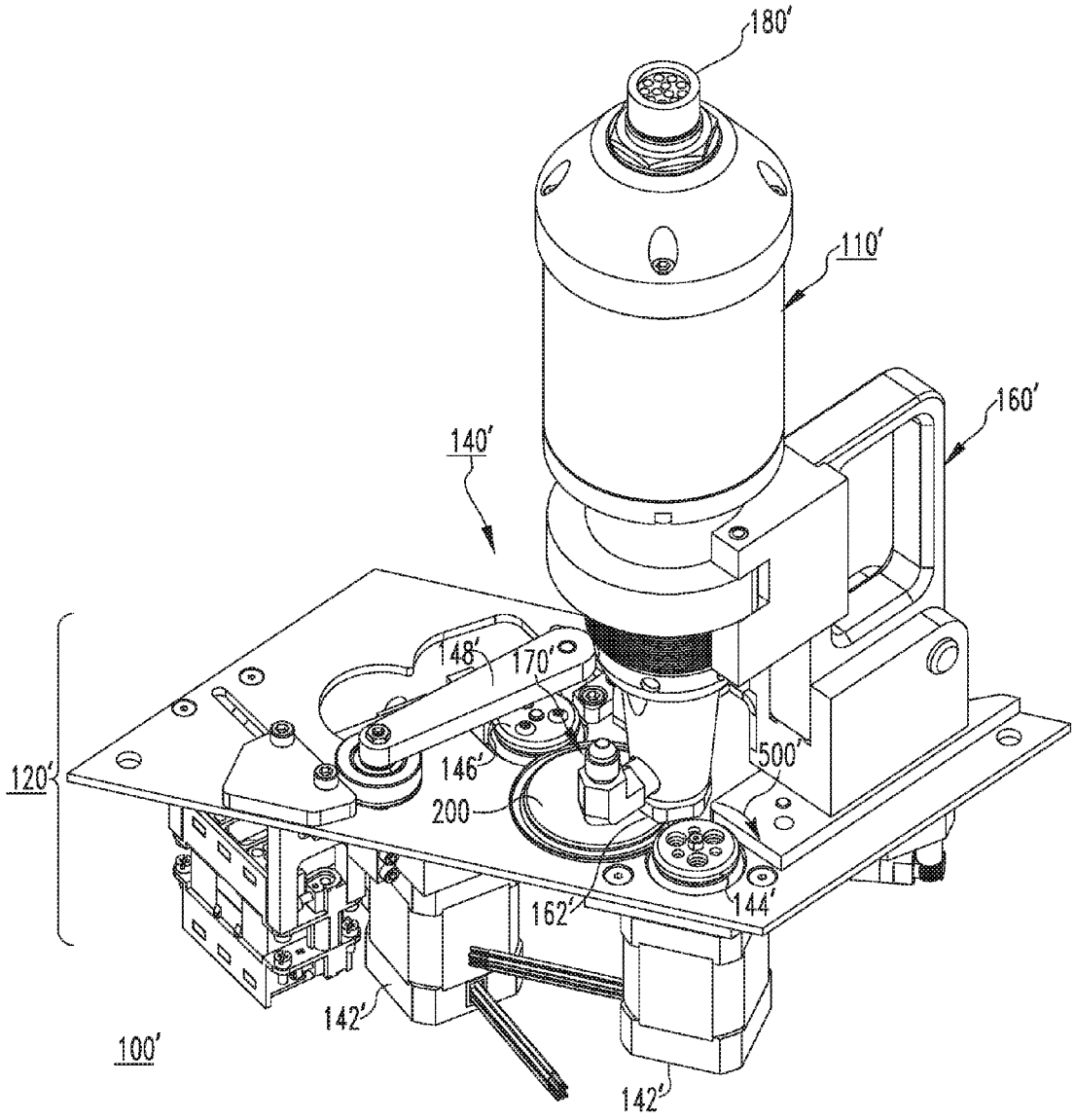
FIG. 6 is an isometric view of a portion of liner, in accordance with another non-limiting embodiment of the disclosed concept.
Figure 7:
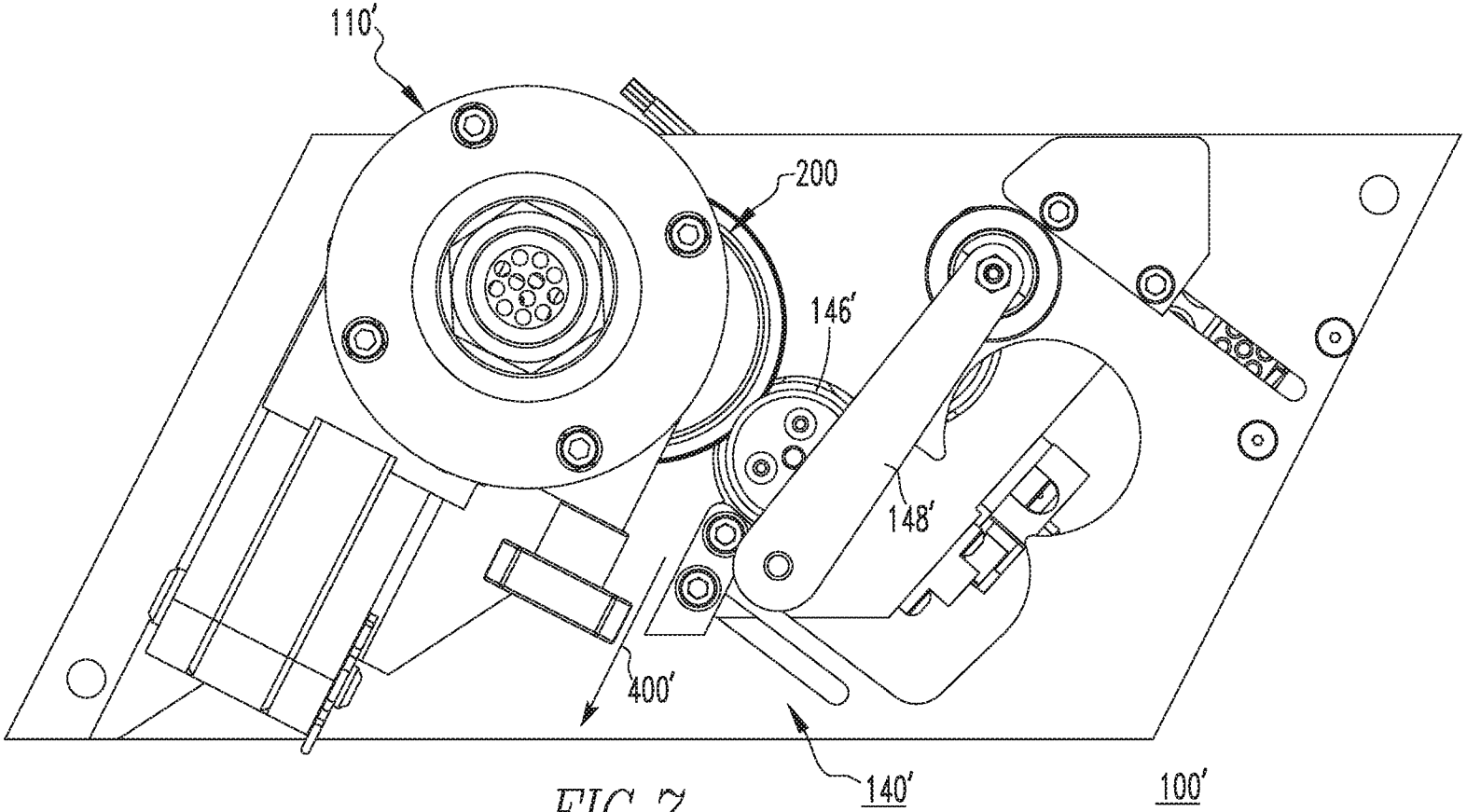
FIG. 7 is a top plan view of the portion of the linear liner of FIG. 6.

FIGS. 6 and 7 show another non-limiting alternative embodiment of a linear liner 100' and, in particular, a single independent lining station 120' therefor, in accordance with the disclosed concept. Specifically, the example of FIGS. 6 and 7 employs an electronic sealant gun 110' and a manipulation mechanism 140' having a different configuration for manipulating the container closures 200 with respect to the sealant gun 110' as the sealant gun 110' dispenses a sealant to line the container closure 200. As with the embodiment of FIGS. 3-5 discussed hereinabove, the sealant gun 110' remains fixed in a stationary position while the container closures 200 are moved (e.g., rotated). However, the manipulation mechanism 140' includes two motors 142' (both partially shown in FIG. 6), which rotate wheel members 144,146 (see, for example, wheel member 144' rotating clockwise in the direction of arrow 500' from the perspective of FIG. 6). This, in turn, spins the container closure 200 with respect to the sealant gun 110', as discussed hereinabove.

As shown in FIG. 6, the electronic sealant gun 110' includes a mount 160' for fixedly mounting the gun 110' in a stationary position. Thus, as previously discussed hereinabove, the manipulation mechanism 140' positions and manipulates the container closure 200 with respect to the gun nozzle 162', as desired. The sealant gun 110' of FIGS. 6 and 7 also includes a sealant or compound supply connection 170' for supplying a volume of compound or sealant to the gun 110', and an electrical connection 180' for providing any known or suitable electrical connections to control the operation of the gun 110' and, in particular, dispersing of sealant from the gun nozzle 162', as desired.

In the non-limiting embodiment of FIGS. 6 and 7, the manipulation mechanism 140' further includes a swinging drive wheel 148' for facilitating the positioning of the container closure 200 with respect to the sealant gun nozzle 162'. The swinging drive wheel 148' may be structured to move in and out (e.g., without limitation, extend (as shown) and retract (not shown)). Accordingly, when the swinging drive wheel 148' is extended, as shown in FIG. 6, it maintains the desired position of the container closure 200 with respect to the sealant gun nozzle 162'. Then, after the container closure 200 has been suitably lined by the sealant gun 112, the swinging drive wheel 148' may be retracted, for example, so that the container closure 200 can be discharged (e.g., without limitation, moved in the direction generally indicated by arrow 400' of FIG. 7) from the independent sealing station 120' onto a suitable discharge mechanism (see, for example and without limitation, discharge conveyor belt 190 of FIGS. 3 and 5). It will be appreciated, however, that any known or suitable alternative type and/or configuration of discharge mechanism (not shown) could be employed, without departing from the scope of the disclosed concept.

Accordingly, the disclosed linear liner 100, 100' provides a machine and associated method for efficiently and effectively lining container closures 200 while avoiding or eliminating a wide variety of disadvantages associated with rotary liner designs (see, for example and without limitation, rotary liner 13 of FIG. 2). Among other benefits, the linear liner 100, 100' eliminates a number of complex components such as rotary unions (e.g., without limitation, electrical and compound unions associated with electrical tank and compound tank assemblies) and processors, and the individual sealant guns (e.g., without limitation, sealant guns 110, 110') are stationary and serve as part of a modular independent lining station design. This allows, for example, a single sealant gun 110, 110' to be stopped, in order to be cleaned and/or maintained, without interrupting the operation of the remainder of the guns (see, for example, sealant guns 112, 114, 116, 118 in FIG. 3). The independent lining station linear liner arrangement also provides for a modular design, which can be relatively easily expanded or otherwise adjusted to accommodate lining a wide variety of different container closures, and can be built around the production output of the shell press, as desired.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. A method of lining container closures in a liner, the method comprising:

providing a base including a number of fluid dispensing apparatus fixed in a stationary position on the base;

conveying a plurality of container closures to the fluid dispensing apparatus using a conveying assembly;

manipulating each of the container closures with respect to a corresponding one of the fluid dispensing apparatus as the fluid dispensing apparatus remains stationary and dispenses a sealant;

lining a plurality of the container closures with said sealant; and discharging the container closures from the liner;

a plurality of said fluid dispensing apparatus disposed in a linear configuration on the base; wherein each of the fluid dispensing apparatus comprises a sealant gun; wherein the liner includes a plurality of independent lining stations; and wherein each independent lining station includes one of the sealant guns.

2. The method of claim 1, further comprising stopping operation of a number of said independent lining stations while the remaining independent lining stations continue to operate to line the container closures.

3. The method of claim 1 wherein the conveying assembly comprises a conveyor belt; and wherein the conveyor belt extends longitudinally across the base to deliver the container closures to each of the independent lining stations.

4. The method of claim 3 wherein the conveying assembly further comprises cleats, wherein the cleats are disposed on the conveyor belt to facilitate movement of the container closures to the independent lining stations.

5. The method of claim 3 wherein the conveying assembly further comprises a supply mechanism for supplying the container closures to the conveyor belt.

6. The method of claim 5 wherein said supply mechanism is a downstacker; and wherein the downstacker is coupled to the base over the conveyor belt.

7. The method of claim 5 wherein said supply mechanism is a belt infeed assembly; and wherein belt infeed assembly comprises an infeed conveyor disposed substantially perpendicularly to the conveyor belt for delivering the container closures onto the conveyor belt.

8. The method of claim 7 wherein said infeed conveyor includes a pair of opposing guides and a stop gate; wherein the pair of opposing guides are structured to guide the container closures toward the conveyor belt; and wherein the stop gate is structured to move between an unactuated position, corresponding to the stop gate being retracted to permit the container closures to continue to move onto the conveyor belt, and an actuated position corresponding to the stop gate being extended to stop movement of the container closures.

9. The method of claim 1, wherein:

said liner includes a manipulation mechanism that comprises a number of motors and at least one wheel member;

each of said wheel member having a radial surface;

wherein each wheel member radial surface is structured to engage a closure; and where the motor rotates the wheel member, thereby spinning the container closures with respect to the dispensing apparatus.

* * * * *